United States Patent [19]

Zeenni et al.

[11] Patent Number: 4,964,372

[45] Date of Patent: Oct. 23, 1990

[54] FINGERNAIL TREATING DEVICE

[76] Inventors: Joseph Zeenni, 30 Churchill Lane, Amsterdam, Netherlands; Antoine Duceppe, 6472 Boul. des Roseraies, Ville D'Anjou, Quebec, Canada, H1M 2S2

[21] Appl. No.: 390,103

[22] Filed: Aug. 7, 1989

[51] Int. Cl.[5] ..... A45D 29/18

[52] U.S. Cl. ..... 132/74.5; 401/206

[58] Field of Search ..... 132/74.5, 73.5, 75; 401/206, 205, 186

[56] References Cited

U.S. PATENT DOCUMENTS

| | | | |
|---|---|---|---|
| 1,753,044 | 4/1930 | Culver . | |
| 2,180,506 | 11/1939 | Burbig | 401/205 |
| 2,804,846 | 9/1957 | Rogers | 401/186 |
| 2,904,811 | 9/1959 | Rabelow | 401/186 |
| 3,101,506 | 8/1963 | Himes et al. | 401/186 |
| 3,201,012 | 8/1965 | De Malglaive | 401/206 |
| 3,341,884 | 9/1967 | Pryor | 15/523 |
| 3,570,396 | 3/1971 | Schwartzman | 401/206 |
| 3,794,213 | 2/1974 | Schwartzman | 401/186 |
| 3,915,577 | 10/1975 | Cropton | 401/186 |
| 4,133,614 | 1/1979 | Baginski et al. | 401/206 |
| 4,149,814 | 4/1979 | Manwaring | 401/206 |
| 4,282,891 | 8/1981 | Duceppe | 132/73.5 |
| 4,466,452 | 8/1984 | Ferrari | 132/75 |
| 4,474,195 | 10/1984 | Warner | 132/74.5 |

FOREIGN PATENT DOCUMENTS 0049759 4/1982 European Pat. Off. .

*Primary Examiner*—Paul J. Hirsch

*Attorney, Agent, or Firm*—Foley & Lardner, Schwartz, Jeffery, Schwaab, Mack, Blumenthal & Evans

[57] ABSTRACT

A fingernail device is provided comprising a container having first and second compartments. A liquid metering valve divides the two compartments. A liquid absorbing sponge having a finger receiving hole is disposed in the first, upper compartment. Nail polish remover is disposed in the second, lower compartment. The second compartment has squeezable side walls whereby, upon squeezing, an amount of liquid is supplied to the first compartment to fill the liquid absorbing sponge with nail polish remover.

5 Claims, 1 Drawing Sheet

FINGERNAIL TREATING DEVICE

BACKGROUND OF THE INVENTION

1. Field of the Invention

The present invention relates to a device for treating fingernails, and more particularly, to a device for removing fingernail polish with the aid of a liquid nail polish remover.

2. Discussion of the Related Art

Fingernail polish is most often removed with a liquid fingernail polish remover such as acetone. A common method involves the use of an ordinary bottle of nail polish remover together with cotton balls. The cotton balls are soaked with fingernail polish remover and rubbed against the surface of the fingernail to remove the fingernail polish. This method works quite well except that the resulting stained, acetone-soaked cotton balls must be disposed of. Additionally, there is always the possibility of spillage of the nail polish remover at some time during the process.

Accordingly, a number of devices have been previously proposed to eliminate or reduce the mess which typically results from these prior methods. For example, Pryor, U.S. Pat. No. 3,341,884, has proposed a device having a nail polish remover reservoir which supplies nail polish remover to an applicator swab made of a coarse material such as mohair.

Another of these devices, Duceppe, U.S. Pat. No. 4,282,891, discloses a cylindrical, flat-bottomed container having a removable cover for holding fingernail polish remover. A sponge pad having a centrally-located finger receiving means is disposed within the container. The fingernail polish remover is absorbed by the sponge, so that upon insertion of the finger into the finger receiving hole and rotation of the finger, the inner surface of the finger receiving hole aids in removing the fingernail polish from the fingernail. This avoids the need for special brushes for removing the fingernail polish. This device, however, has suffered the disadvantage that the fingernail polish remover must be periodically poured into the container to replace that which has been used. Thus, the device is not entirely self-contained and does not completely eliminate the spillage problem.

A self-contained nail polish removing device was proposed by Autenrieth, EP-No. 49-759. This device comprises a cylindrical container divided into two parts by a perforated platform. The lower part is filled with nail polish remover, while a sponge having a finger slit is disposed in the upper part. When the cylindrical container is shaken, nail polish remover moves from the lower part through the perforated platform to soak the sponge with fingernail polish remover. The finger is then inserted into the finger slit to remove the fingernail polish.

This device also suffers from disadvantages. First of all, shaking the container to soak the sponge with nail polish can, at times, prove to be a messy experience. For instance, if the lid is not sealed properly, the nail polish remover can easily be sprayed onto the user during the shaking process. Additionally, it is considered to be cost efficient to be able to detach a self-contained nail polish removing device from its source of nail polish remover.

SUMMARY OF THE INVENTION

Accordingly, it is an object of the present invention to provide a nail polish removing device which is self-contained and not prone to spilling.

It is a further object of the present invention to provide a nail polish removing device which may be connected to a container of fingernail polish remover.

It is another object of the present invention to provide a nail polish removing device wherein the nail polish remover may be replenished in the device by squeezing the nail polish remover supply container.

It is still a further object of the present invention to provide a nail polish removing device which may be detachably connected to a squeezable nail polish remover bottle.

The foregoing and additional objects are obtained by providing a device for treating fingernails comprising a container having first and second compartments. A liquid metering valve divides the two compartments. A liquid absorbing sponge having a finger receiving hole is disposed in the first, upper compartment. Nail polish remover is disposed in the second, lower compartment. The second compartment has squeezable side walls whereby, upon squeezing, an amount of liquid is supplied to the first compartment to fill the liquid absorbing sponge with nail polish remover.

A second embodiment of the present invention comprises a container having only a first compartment. A liquid metering valve forms a lower portion of a compartment. The liquid metering valve is surrounded by a threaded portion so that the container may be threadably attached to an existing bottle of nail polish remover.

Further objects and advantages of the present invention will become apparent to those of skill in the art from the drawings and specification which follow.

DETAILED DESCRIPTION OF THE PREFERRED EMBODIMENTS

Figure 1:
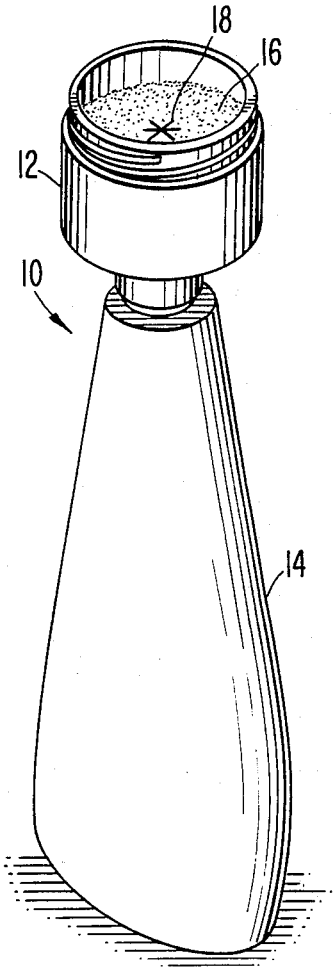
FIG. 1 is a perspective view of a first embodiment of a fingernail polish removing device according to the present invention.
Figure 4:
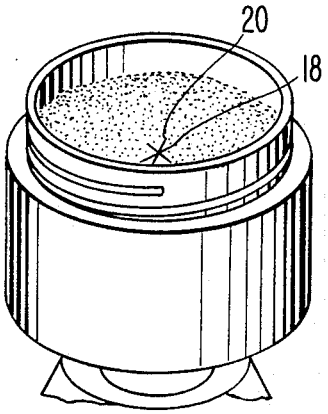
FIG. 4 is a top perspective view of the fingernail polish removing device.

The present invention, as illustrated in FIG. 1, contemplates a fingernail treating device, designated generally by the reference numeral 10 having a first upper compartment 12 and a second lower compartment 14. The lower compartment 14 is at least partially filled with liquid nail polish remover. The upper compartment contains a liquid absorbing sponge member 16 having defined therein a generally centrally located finger receiving hole 18. The finger receiving hole may advantageously be formed from a plurality of intersecting slits 20, as shown in FIG. 4. The upper compartment is constructed generally as disclosed in U.S. Pat. No. 4,282,891, which is hereby incorporated by reference.

Figure 2:
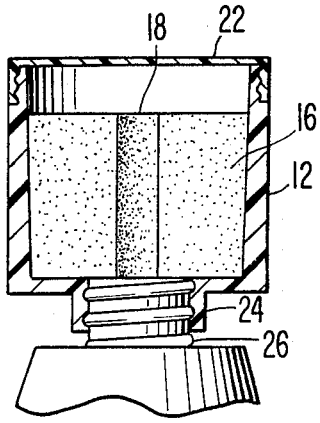
FIG. 2 is a partial vertical cross-section of a fingernail polish removing device according to the present invention.

Referring now to FIG. 2, there is shown a partial cross-section of the upper compartment of a fingernail polish removing device according to the present invention. As shown in this figure, a removable lid 22 is threadably disposed atop the upper compartment 12. Additionally, a lower threaded portion 24 of the upper compartment 12 threadably engages a threaded portion 26 of lower compartment 14.

Figure 3:
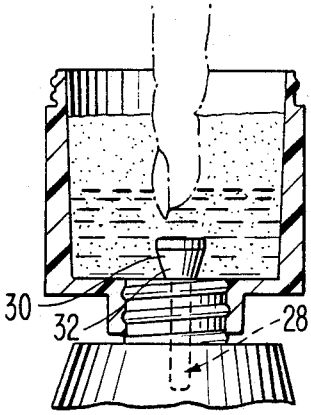
FIG. 3 is a partial vertical cross-section of the fingernail polish removing device in use.

As illustrated in FIG. 3, a liquid metering means such as valve assembly 28 separates the upper compartment from the lower compartment. While a valve assembly is considered particularly advantageous, the liquid metering means may take on many forms and may even be as simple as a slitted diaphragm. The lower compartment 14 is formed from a squeezable material such as soft plastic so that upon squeezing the side walls of the lower compartment 14 valve 30 is unseated from a valve seat to allow nail polish remover to flow from the lower compartment 14 into the upper compartment 12 and thereby soak the sponge 16 with nail polish remover.

Figure 5:
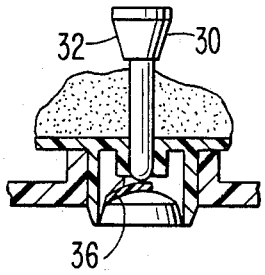
FIG. 5 is a cross-section of a representative liquid metering valve according to the present invention.

FIG. 5 shows a detail of a valve assembly which may be used with the present invention. As depicted herein, the valve 30 includes an angled portion 32 which abuts a valve seat. The seat 30 includes a helical spring portion so that when the lower compartment 14 is no longer being squeezed, the valve will close, thereby preventing more liquid from entering the upper compartment 12. Although a valve assembly 28 having an angled portion 32 and helical spring 34 is depicted herein, it is obvious that many different valve assemblies may be used without departing from the spirit of the present invention.

It should become obvious to those skilled in the art that this invention is not limited to the preferred embodiments shown and described. For example, the bottle and upper compartment may take on many different shapes. Additionally, different valve assemblies are contemplated by the present invention.

What is claimed is:

1. A device for treating fingernails comprising:
a container having first and second compartments;
a liquid metering means disposed between the compartments;
a liquid absorbing member disposed in the first compartment;
said liquid absorbing member having defined therein a finger receiving means;
a fingernail treating liquid disposed in the second compartment;
said second compartment having a squeezable side wall whereby, upon squeezing, an amount of liquid is forced into the first compartment through the liquid metering means.

2. The device according to claim 1 wherein said liquid metering means is a resilient valve having a first closed position and a second open position, actuatable upon squeezing of the sidewalls of the second compartment.

3. A method of treating fingernails, comprising the steps of:
providing a two-compartment container having a liquid metering means disposed between the two compartments;
placing a liquid absorbing member within a first of the two compartments;
at least partially filling a second of the two compartments with fingernail treating liquid;
providing the liquid absorbing member with a finger receiving means;
squeezing an outer wall of the second compartment to force an amount of the fingernail treating liquid through the liquid metering means into the first compartment;
inserting at least the end of the finger into the finger receiving means to treat the fingernail.

4. The device according to claim 3 wherein said liquid metering means is a resilient valve having a first closed position and a second open position, actuatable upon squeezing of the sidewalls of the second compartment.

5. A device for treating fingernails comprising:
a generally cylindrical container;
a liquid absorbing member disposed in the container;
finger receiving means defined in the liquid absorbing member;
a liquid metering means disposed in a portion of a wall of the container;
means, forced on the container at said portion, for removably attaching the container to a means for supplying nail treating liquid, whereby upon squeezing the liquid supplying means, nail treating liquid is forced through the liquid metering means and into the container.

* * * * *